US011246443B2

(12) United States Patent
Lin

(10) Patent No.: US 11,246,443 B2
(45) Date of Patent: Feb. 15, 2022

(54) SECURE CONTAINING DEVICE

(71) Applicant: NANNING FUGUI PRECISION INDUSTRIAL CO., LTD., Nanning (CN)

(72) Inventor: Zhi-Ming Lin, Nanning (CN)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 96 days.

(21) Appl. No.: 16/852,764

(22) Filed: Apr. 20, 2020

(65) Prior Publication Data

US 2020/0352377 A1 Nov. 12, 2020

(30) Foreign Application Priority Data

May 6, 2019 (CN) ..... 201910373194.2

(51) Int. Cl.
*A47G 29/14* (2006.01)
*B65D 21/08* (2006.01)

(52) U.S. Cl.
CPC ..... *A47G 29/141* (2013.01); *B65D 21/086* (2013.01); *A47G 2029/145* (2013.01); *A47G 2029/149* (2013.01)

(58) Field of Classification Search
CPC ..... A47G 29/124; A47G 29/20; A47G 29/22; A47G 29/141; A47G 29/14; A47G 29/16; A47G 2029/148; A47G 2029/145; A47G 2029/149; B65D 7/24; B65D 7/26; B65D 7/28; B65D 21/086; B65D 33/00; B65D 33/14; B65D 11/18; B65D 11/1846; B65D 55/02
USPC ..... 232/17, 19, 38, 44, 45, 1 E; 220/6, 476, 220/666; 383/12, 22; 340/569
See application file for complete search history.

(56) References Cited

U.S. PATENT DOCUMENTS 2,456,479 A * 12/1948 Antil ..... A47G 29/14 220/6
6,426,699 B1 * 7/2002 Porter ..... A47F 10/00 221/2
6,540,134 B1 * 4/2003 Rasche ..... A47G 29/14 220/4.28
10,076,204 B1 * 9/2018 Sadeghi ..... A47G 29/141
10,299,617 B1 * 5/2019 Castellanos ..... A47G 29/141
(Continued)

FOREIGN PATENT DOCUMENTS

CN 105151462 A 12/2015
CN 206507728 U 9/2017
(Continued)

*Primary Examiner* — William L Miller
(74) *Attorney, Agent, or Firm* — ScienBiziP, P.C.

(57) ABSTRACT

A secure containing device with an adjustable volume for receiving and safeguarding items includes a bag, a rear cover, a mounting element connected to opposite sides of the bag, a lock assembly on the rear cover and protruding toward the mounting element, and an active element overlapping with the mounting element. When the mounting element moves to a closed position, the bag is compressed. When the mounting element moves to an unfolded position away from the rear cover, the bag presents a containing space. When the mounting element is in the unfolded position, the active element is movable and rotatable relative to the mounting element to cover a top of the bag and engage with the lock assembly.

10 Claims, 10 Drawing Sheets

(56) References Cited

U.S. PATENT DOCUMENTS

| | | | | |
|---|---|---|---|---|
| 10,321,780 | B1 * | 6/2019 | James | A47G 29/141 |
| 10,537,196 | B1 * | 1/2020 | MacPherson | A47G 29/20 |
| 10,696,453 | B2 * | 6/2020 | Sena | A47G 29/141 |
| 10,709,276 | B2 * | 7/2020 | Guanch | A47G 29/20 |
| 10,743,695 | B1 * | 8/2020 | Altmaier | A47G 29/20 |
| 10,758,071 | B1 * | 9/2020 | Lin | A47G 29/141 |
| 11,109,705 | B2 * | 9/2021 | Raphael | A47G 29/20 |
| 2017/0127868 | A1 * | 5/2017 | Adewuyi | A47G 29/141 |
| 2018/0125278 | A1 | 5/2018 | Jiang | |
| 2019/0225375 | A1 * | 7/2019 | Sena | A47G 29/141 |
| 2019/0320836 | A1 * | 10/2019 | Guanch | A47G 29/20 |

FOREIGN PATENT DOCUMENTS

| | | | | |
|---|---|---|---|---|
| CN | 107518751 | A | 12/2017 | |
| CN | 206691596 | U | 12/2017 | |
| CN | 108082663 | A | 5/2018 | |
| CN | 207843659 | U | 9/2018 | |
| CN | 108910228 | A | 11/2018 | |
| DE | 102014110688 | A1 * | 2/2016 | A47G 29/20 |
| JP | H06329190 | A | 11/1994 | |
| WO | 0167929 | A2 | 9/2001 | |
| WO | 2016182595 | A1 | 11/2016 | |
| WO | 2017014521 | A1 | 1/2017 | |

* cited by examiner

SECURE CONTAINING DEVICE

FIELD

The subject matter herein generally relates to a containing device, in particular to a secure containing device having a security mechanism and an adjustable volume.

BACKGROUND

The use of Internet to buy and sell goods and transporting goods through logistics systems have become a common trading mode in recent years.

Logistics personnel may avoid making face-to-face contact with the receiving customer or the delivery customer to complete delivery or pickup operation if a secure facility can be made available.

BRIEF DESCRIPTION OF THE DRAWINGS

Many aspects of the present disclosure are better understood with reference to the following drawings. The components in the drawings are not necessarily drawn to scale, the emphasis instead being placed upon clearly illustrating the principles of the present disclosure. It will be appreciated that for simplicity and clarity of illustration, where appropriate, reference numerals have been repeated among the different figures to indicate corresponding or analogous elements.

DETAILED DESCRIPTION

Figure 1:
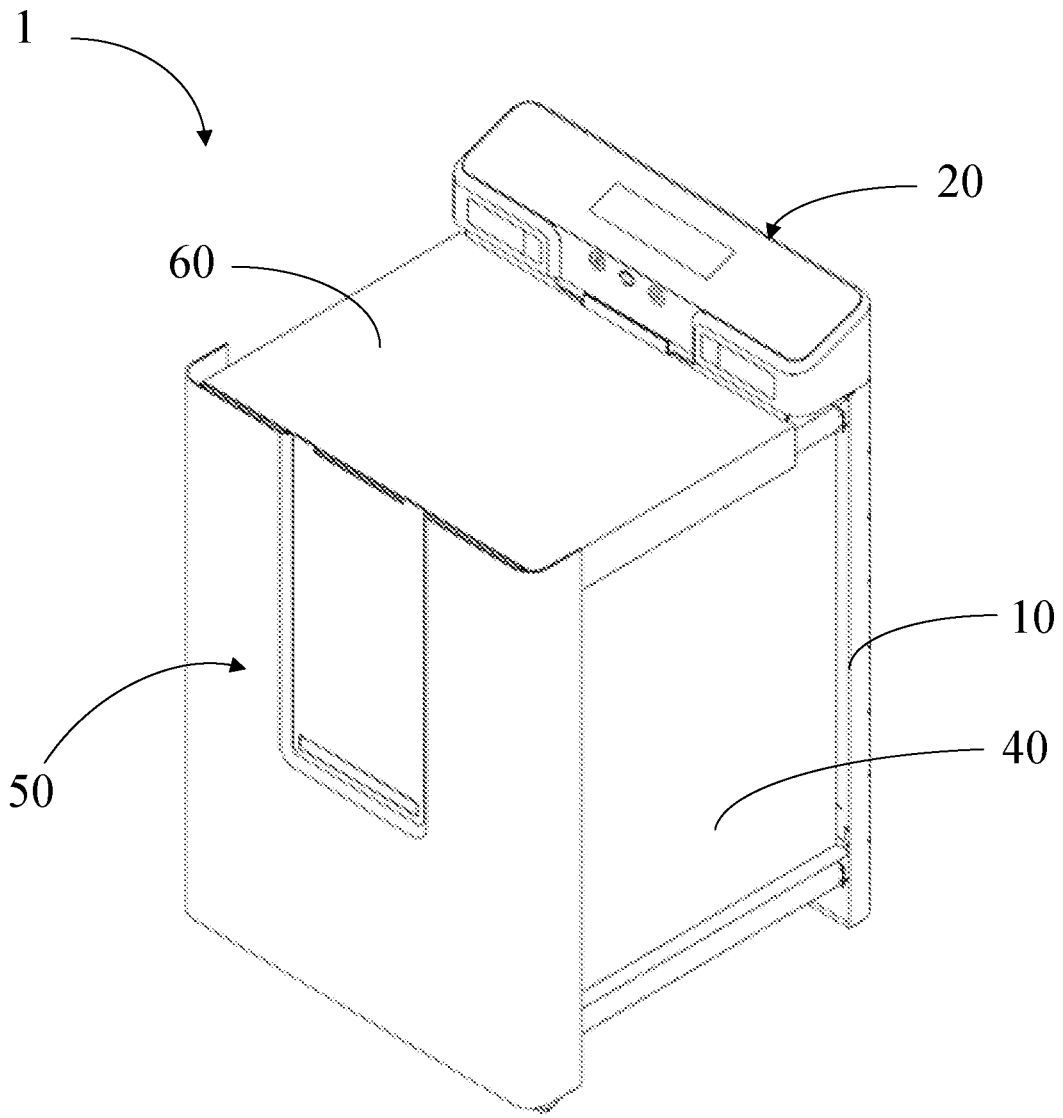
FIG. 1 is a schematic view of a secure containing device in accordance with one embodiment of the present disclosure, where an active element covers a top of a bag and engages with a lock assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of embodiments and not by way of limitation in the figures of the accompanying drawings, in which like references indicate similar elements. It should be noted that references to "an" or "one" embodiment in this disclosure are not necessarily to the same embodiment, and such references mean "at least one."

The terms "coupled" and "connected" are defined as directly or indirectly through intervening components. The connection can be such that the objects are permanently connected or releasably connected. The term "comprising," when utilized, means "including, but not necessarily limited to"; it specifically indicates open-ended inclusion or membership in the so-described combination, group, series, and the like.

Figure 2:
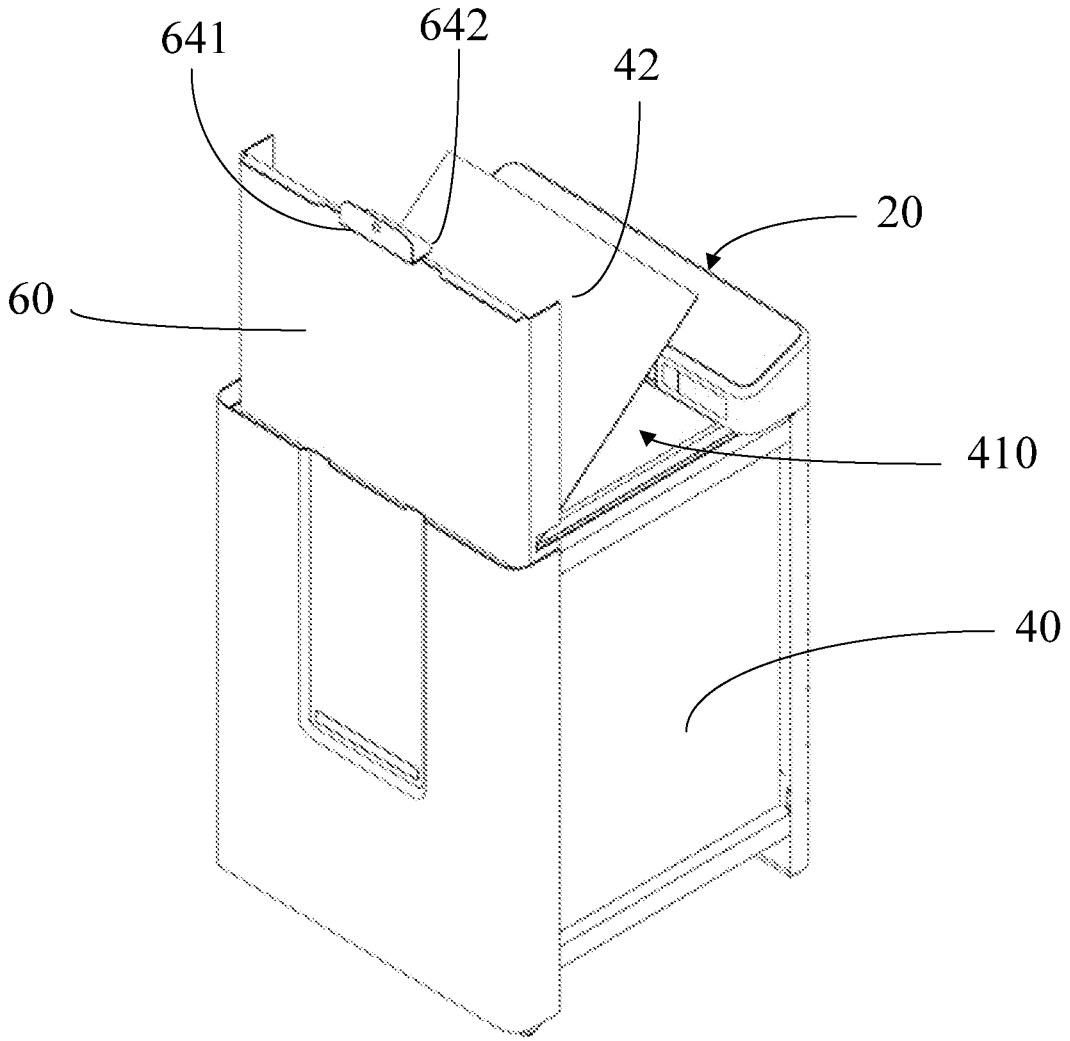
FIG. 2 is a schematic view of the secure containing device of FIG. 1, where the active element does not cover the top of the bag and is separated from the lock assembly.

According to one embodiment of the present disclosure, as shown in FIG. 1, a secure containing device 1 with an adjustable volume for receiving and safeguarding items is provided. A bag 40 of the secure containing device 1 may be covered by an active element 60, thereby sealing the bag 40 to prevent items in the bag 40 from being stolen. Moreover, as shown in FIG. 2, after an authorized user has released a lock assembly 20, the active element 60 can be separated from the lock assembly 20 to allow the user to open the bag 40 for picking up or unloading the items in the bag 40. In this way, the items placed inside the bag 40 are secure.

According to one embodiment of the present disclosure, a structure of the secure containing device 1 is described as follows.

Figure 3:
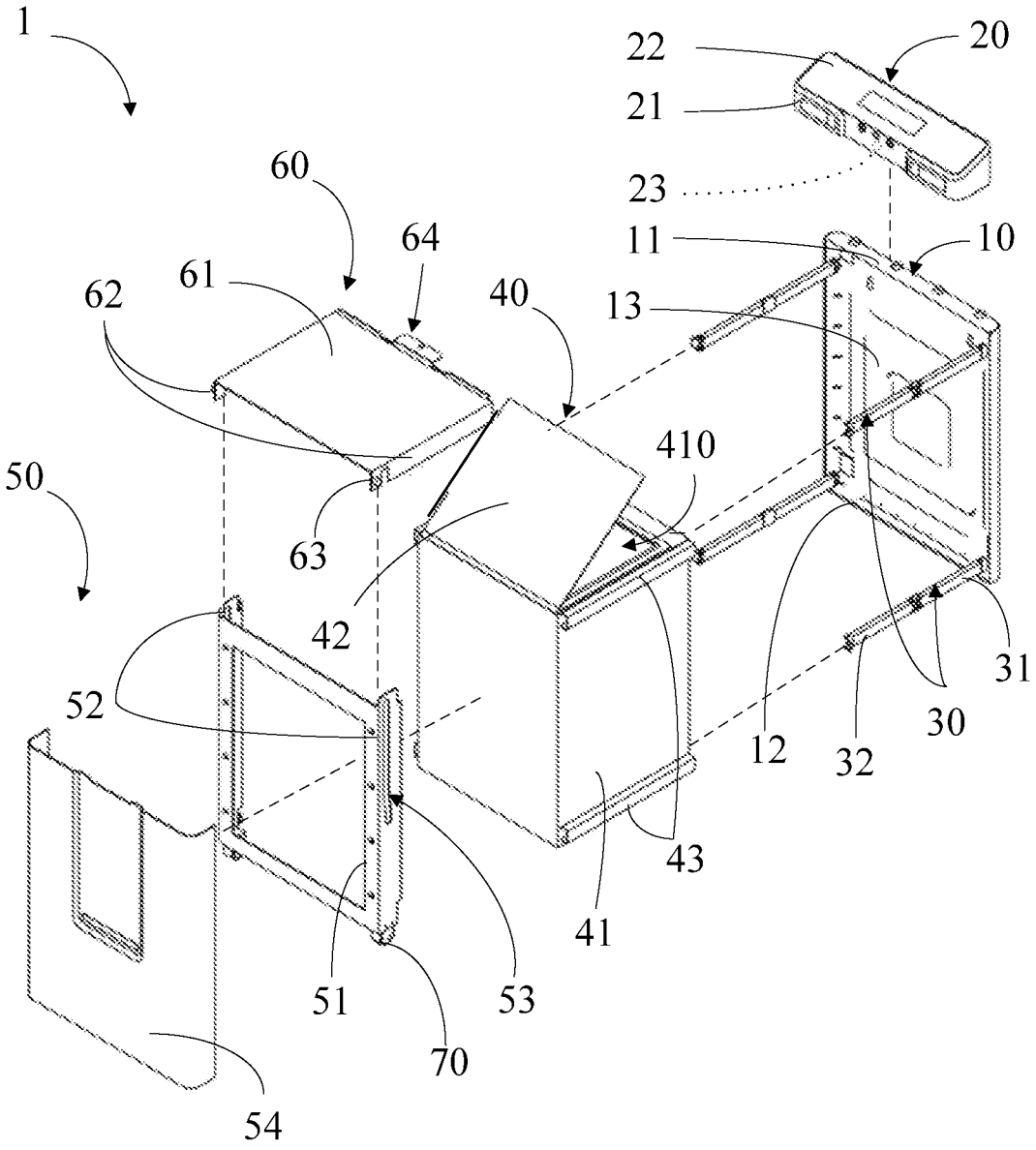
FIG. 3 is an exploded view of the secure containing device of FIG. 1.

FIG. 3 is an exploded view of the secure containing device 1 in accordance with one embodiment of the present disclosure. According to one embodiment of the present disclosure, the secure containing device 1 includes a rear cover 10, the lock assembly 20, four connecting-rod assemblies 30, the bag 40, a mounting element 50, and the active element 60. The components of the secure containing device 1 can be increased or decreased according to demand, and they are not limited to this embodiment.

In one embodiment, the bag 40 is a bag-like structure, including a body 41 and an inner cover 42. The body 41 has an opening 410 at a top of the body 41. A user can remove items placed in a containing space inside the body 41, or can deposit items into the containing space inside the body 41 via the opening 410. One side of the inner cover 42 is connected to an edge of the opening 410, and the opening 410 can be closed by a suitable mechanism (e.g. zip). In one embodiment, both the body 41 and the inner cover 42 have waterproof coating. Since the bag 40 has a waterproof function, the items inside the bag 40 can be prevented from getting wet or being flooded due to external environmental factors.

Figure 4:
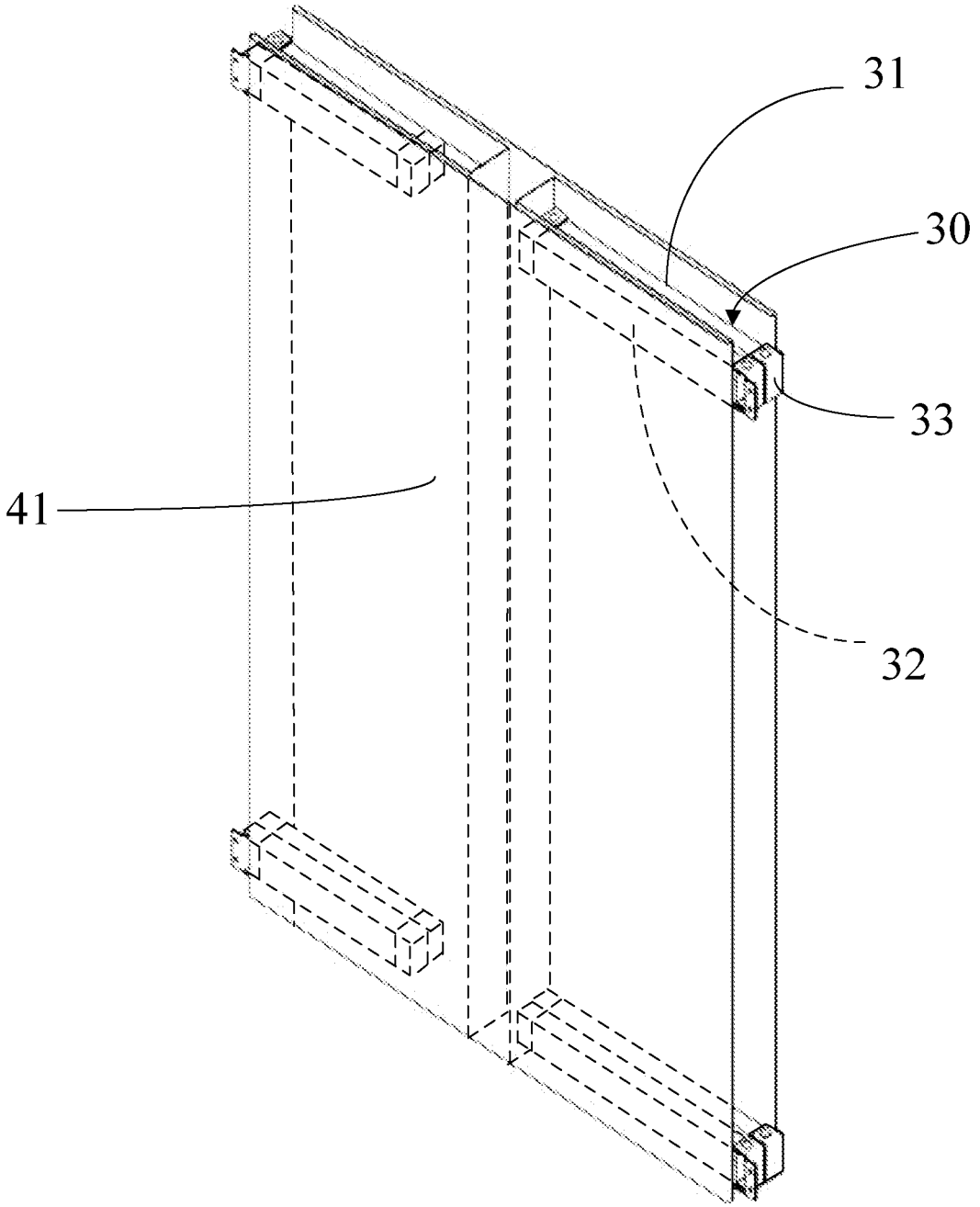
FIG. 4 is a schematic view of the bag and connecting-rod assemblies of the secure containing device of FIG. 1.

In one embodiment, each of the four connecting-rod assemblies 30 includes a first connecting rod 31, a second connecting rod 32, and a hinge 33 connected to the first connecting rod 31 and the second connecting rod 32. An end of the first connecting rod 31 far away from the second connecting rod 32 is affixed to the rear cover 10 by a hinge. An end of the second connecting rod 32 far away from the first connecting rod 31 is affixed to the mounting element 50 by a hinge. The bag 40 further includes a number of sleeves 43 disposed on two opposite sides of the bag 40 and close to upper and lower edges of the bag 40. Each of the sleeves 43 extends along one of the edges of the bag 40, and thus the four connecting-rod assemblies 30 can pass through the sleeves 43. The bag 40 is connected to the mounting element 50 by the four connecting-rod assemblies 30 and the rear cover 10. Due to the design of the four connecting-rod assemblies 30, the bag 40 can have a flat look on each side surface thereof in an unfolded state (as shown in FIG. 3), and the bag 40 can have a very small volume in a compressed state (as shown in FIG. 4).

However, it should be noted that the present disclosure is not limited to this embodiment. In another embodiment, the secure containing device 1 may not include the four connecting-rod assemblies 30 and the connecting-rod assemblies 30, and thus the bag 40 is directly connected to the rear cover 10 and the mounting element 50.

As shown in FIG. 3, the lock assembly 20 is affixed to a top edge 11 of the rear cover 10, and protrudes toward the mounting element 50 relative to a front surface 13 of the rear cover 10. In one embodiment, the lock assembly 20 is an electronic lock, and has a housing 21, a control panel 22, and a physical lock 23. The control panel 22 is disposed on a top surface of the housing 21. The control panel 22 may include a display screen, a microphone, and one or more devices for detecting the identity of a person (for example: a camera for face recognition, an optical sensor for sensing a two-dimensional barcode, etc.). The physical lock 23 is disposed on a bottom surface of the housing 21, and moveable relative to the housing 21.

In one embodiment, when user information obtained by the control panel 22 matches a default setting of the lock assembly 20, the control panel 22 sends a detection signal to a control system (not shown in figures). After the control system receives the detection signal, the control system sends a control signal to a driver (not shown in figures) coupled to the physical lock 23 and activates the driver. Afterwards, the driver drives the physical lock 23 back into the housing 21, thereby completing an unlocking process. Conversely, when the user information obtained by the control panel 22 does not match, the physical lock 23 is not released. Identity data can be obtained or updated from a database via a wireless network in time.

The mounting element 50 faces the rear cover 10, and the bag 40 is located between the rear cover 10 and the mounting element 50. In one embodiment, the mounting element 50 includes a front frame 51, two side frames 52, and a decorative plate 54. The decorative plate 54 is at a side of the front frame 51. The two side frames 52 are disposed on two opposite sides of the front frame 51, and the two opposite sides are in a horizontal direction. Each of the two side frames 52 has a guiding track 53 extending along a longitudinal direction of the two side frames 52.

Figure 5:
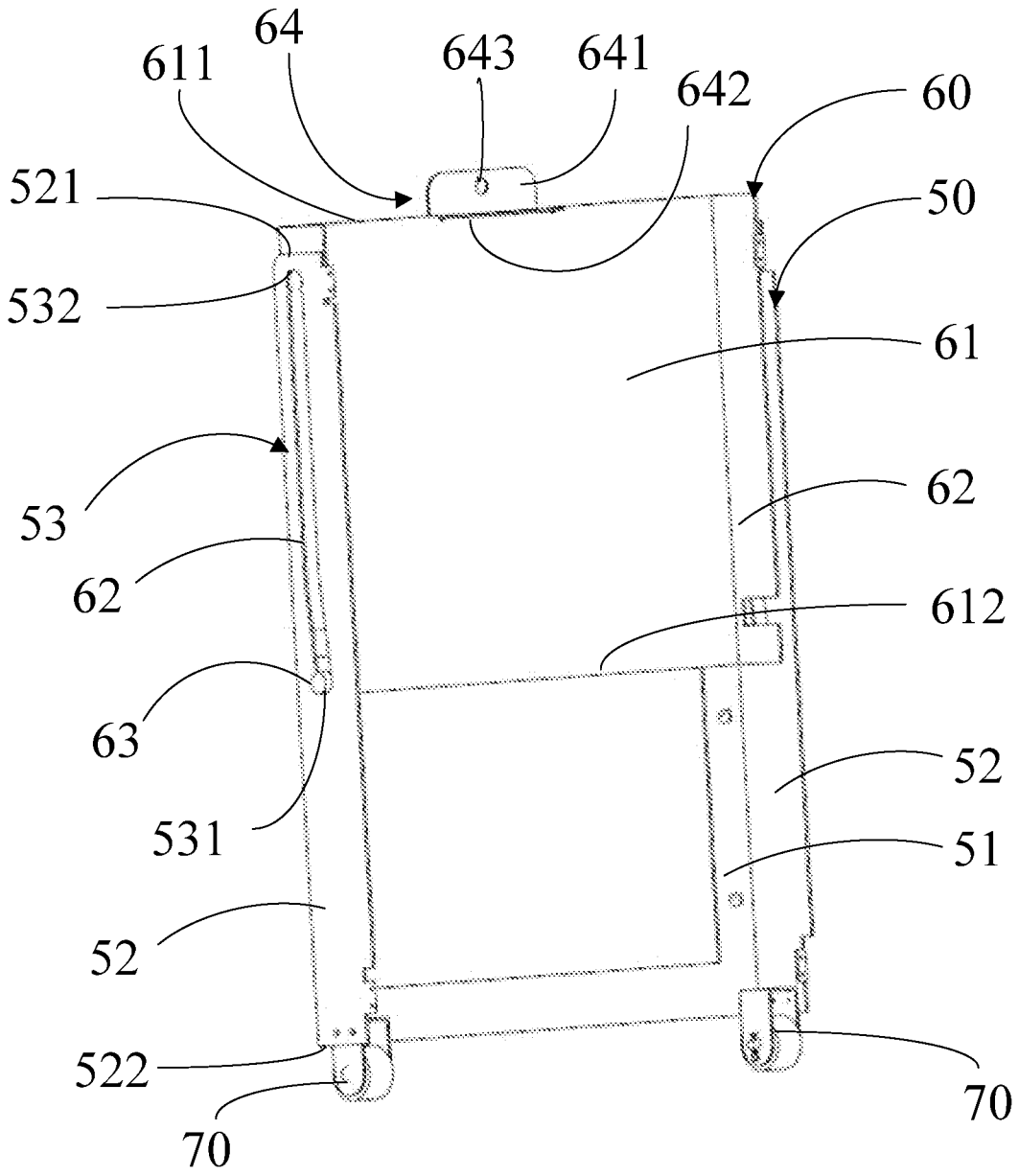
FIG. 5 is a schematic view of a mounting element and the active element of the secure containing device of FIG. 1.

In particular, as shown in FIG. 5, the guiding track 53 extends from a first end 531 to a second end 532. The first end 531 of the guiding track 53 is in a center area of each of the two side frames 52, and the second end 532 of the guiding track 53 is adjacent to a top edge 521 of each of the two side frames 52. Moreover, a segment of the guiding track 53 close to the first end 531 is inclined away from the front frame 51 (This feature will be explained later in the embodiment of FIG. 6). Wheels 70 are disposed on bottom edges 522 of the two side frames 52 to assist the mounting element 50 to move on a horizontal plane.

The active element 60 can moveably disposed on the mounting element 50. In one embodiment, the active element 60 includes a top frame 61, two side frames 62, and a retaining portion 64. In one embodiment, the retaining portion 64 is connected to a top edge 611 of the top frame 61, and includes a first retaining sheet 641 and a second retaining sheet 642 (as shown in FIG. 2). The first retaining sheet 641 is perpendicular to the second retaining sheet 642, and the first retaining sheet 641 and the second retaining sheet 642 have locking holes 643. A shape of the locking holes 643 corresponds to a shape of the physical lock 23 of the lock assembly 20, and thus the physical lock 23 can pass through the locking holes 643.

The two side frames 62 extend from two opposite sides of the top frame 61, and the two opposite sides are in a horizontal direction. Two cylindrical protrusions 63 are formed on outer surfaces of the two side frames 62, and adjacent to a bottom edge 612 of the top frame 61. The active element 60 is mounted on the mounting element 50 by the two cylindrical protrusions 63 and the guiding tracks 53.

Figure 6:
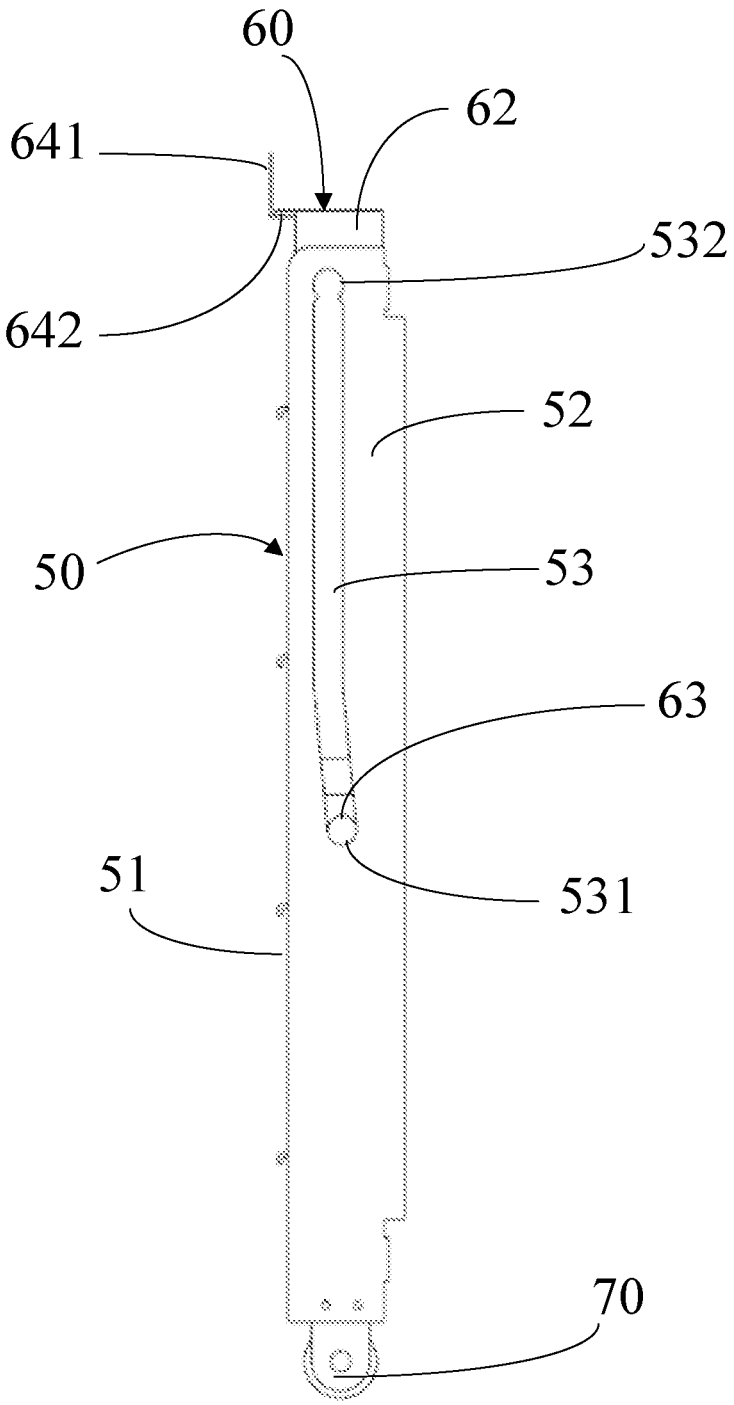
FIG. 6 is a side view of FIG. 5 showing the active element overlapped with the mounting element.

In one embodiment, the active element 60 can slide to different locations of the guiding tracks 53 by a movement of the two cylindrical protrusions 63 relative to the guiding tracks 53, and thus the active element 60 can be in an overlapping position or a functional position relative to the mounting element 50. In particular, as shown in FIG. 6, when each of the two cylindrical protrusions 63 of the active element 60 slides to the first end 531 of the guiding track 53, the active element 60 is in the overlapping position relative to the mounting element 50. The segment of the guiding track 53 that is close to the first end 531 is inclined in a direction away from the front frame 51. Therefore, when each of the two cylindrical protrusions 63 moves toward the first end 531, a portion of the active element 60 that is close to the top edge 611 abuts against the front frame 51. The structural stability of the active element 60 is increased and the active element 60 cannot be shaken in the front frame 51, when it is overlapped in the mounting element 50.

Figure 7:
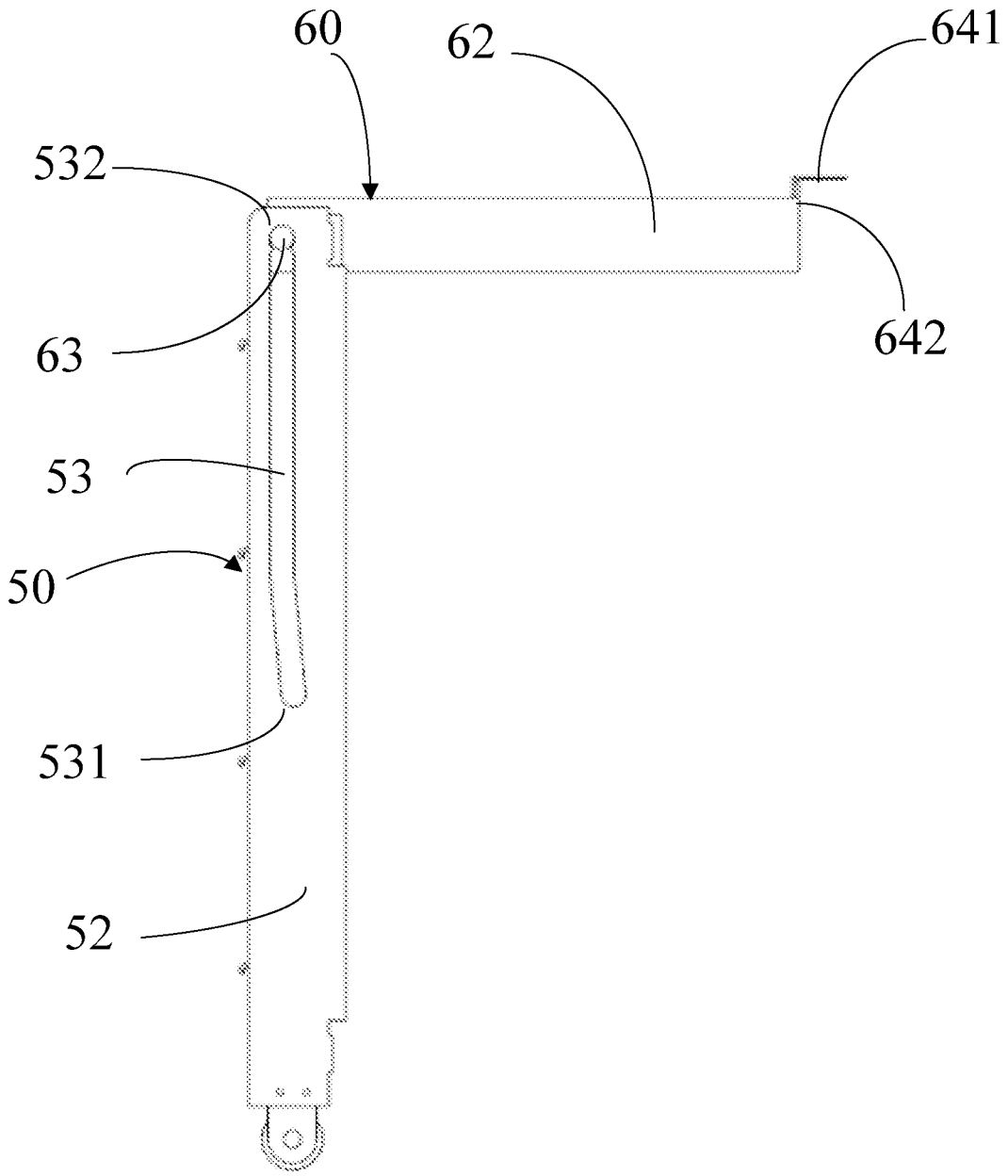
FIG. 7 is a schematic view according to FIG. 6 showing the active element perpendicular to the mounting element.

On the other hand, as shown in FIG. 7, when each of the two cylindrical protrusions 63 of the active element 60 slides to the second end 532 of the guiding track 53, the active element 60 can be rotated relative to the mounting element 50 and set to the functional position. In the functional position, an angle between the active element 60 and the mounting element 50 may be equal to or approximately equal to 90 degrees. In the present disclosure, the term "approximately equal to" includes "equal to".

It should be understood that the present disclosure is not limited to the described embodiments. In another embodiment, the active element 60 is made of flexible material. The mounting element 50 includes a stick for the active element 60 winding. The active element 60 is wound on the stick in the overlapping position, and the active element 60 is drawn from the stick in the functional position.

As shown in FIGS. 8 to 13, according to one embodiment of the present disclosure, operation of the secure containing device 1 is as follows.

Figure 8:
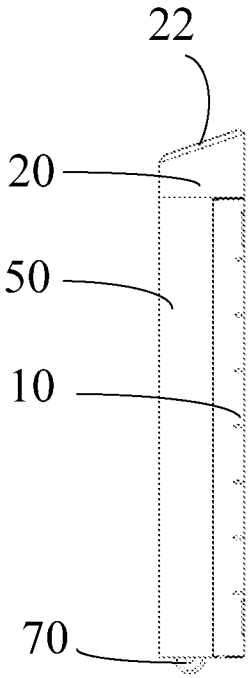
FIG. 8 is a schematic view showing the secure containing device of FIG. 1 in a compressed position.

In one embodiment, when the secure containing device 1 does not need to carry items, as shown in FIG. 6, the active element 60 is set to the overlapping position. Moreover, as shown in FIG. 8, the mounting element 50 can be moved toward the rear cover 10 and placed under the lock assembly 20, so as to be in a closed position. At this time, the bag 40 between the mounting element 50 and the rear cover 10 is compressed by the mounting element 50 and the rear cover 10. As shown in FIG. 4, when the bag 40 is compressed, an angle between the first connecting rod 31 and the second connecting rod 32 of each of the four connecting-rod assemblies 30 will be set at a first angle. The first angle may be less than 10 degrees, or equal to 0 degree. On the other hand, because the second retaining sheet 642 of the retaining portion 64 is in a horizontal configuration (as shown in FIG. 6), the physical lock 23 of the lock assembly 20 can pass through the locking hole 643 of the second retaining sheet 642, thereby limiting a movement of the mounting element 50 relative to the rear cover 10.

Figure 9:
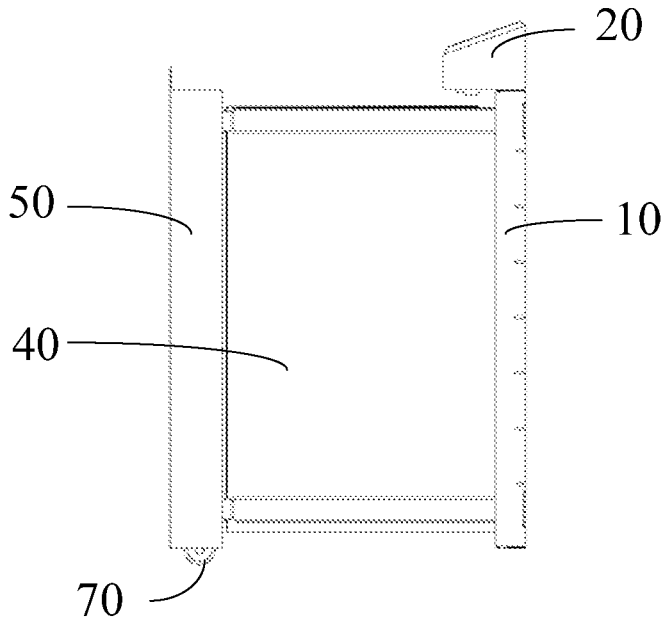
FIG. 9 is a schematic view showing the secure containing device of FIG. 1 in an unfolded position, where the bag defines a containing space.

The processes for depositing items into the bag 40 are as follows. The lock assembly 20 is opened by operating the control panel 22, so as to release the second retaining sheet 642. Afterwards, as shown in FIG. 9, the mounting element 50 can be moved away from the rear cover 10, so that the secure containing device 1 can be in an unfolded position. In one embodiment, the mounting element 50 slides on a flat plane via the wheels 70, and thus the mounting element 50 can move smoothly. In one embodiment, when the secure containing device 1 is in the unfolded position, the bag 40 is in the unfolded state, and presents a containing space for receiving items. Moreover, a second angle is between the first connecting rod 31 and the second connecting rod 32 of each of the four connecting-rod assemblies 30. The second angle is greater than the first angle, and is less than or equal to 180 degrees. For example, when the secure containing device 1 is in the unfolded position, the first connecting rod 31 is parallel to the second connecting rod 32 (as shown in FIG. 3), and the angle between the first connecting rod 31 and the second connecting rod 32 is 180 degrees.

Figure 10:
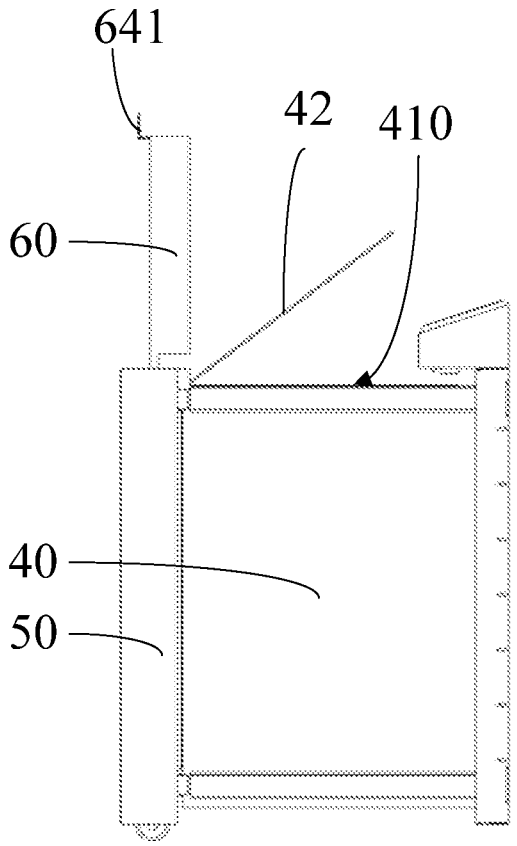
FIG. 10 is a schematic view according to FIG. 9 showing the active element moved out from the mounting element.

Next, as shown in FIG. 10, the inner cover 42 of the bag 40 is opened, and the items can be put into the bag 40. Moreover, the active element 60 is left up by holding the first retaining sheet 641. At this time, as shown in FIGS. 6 and 7, each of the two cylindrical protrusions 63 of the active element 60 slides from the second end 532 of the guiding track 53 to the first end 531 of the guiding track 53.

Figure 11:
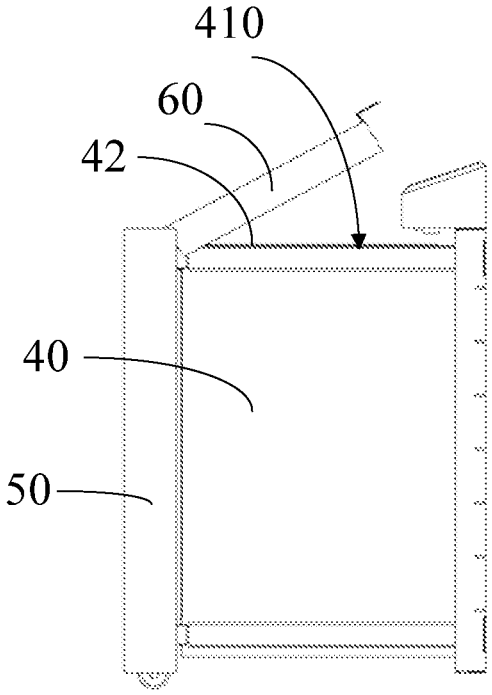
FIG. 11 is a schematic view according to FIG. 9 showing the active element covering the bag.
Figure 12:
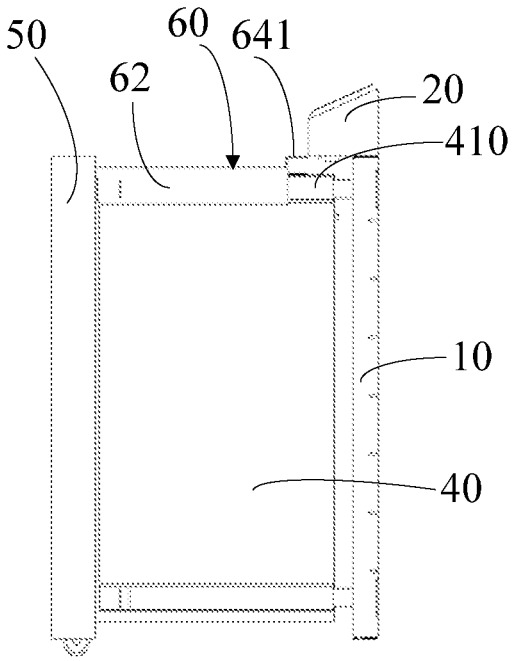
FIG. 12 is a schematic view according to FIG. 9 showing the active element covering the top of the bag.

Next, as shown in FIG. 11, the inner cover 42 of the bag 40 is closed to seal the opening 410 of the bag 40. Afterwards, as shown in FIG. 12, by holding the first retaining sheet 641, the active element 60 can rotates 90 degrees relative to the mounting element 50, so that the active element 60 is set to a functional position relative to the mounting element 50, and covers the top of the bag 40 to limit the inner cover 42 opening.

Figure 13:
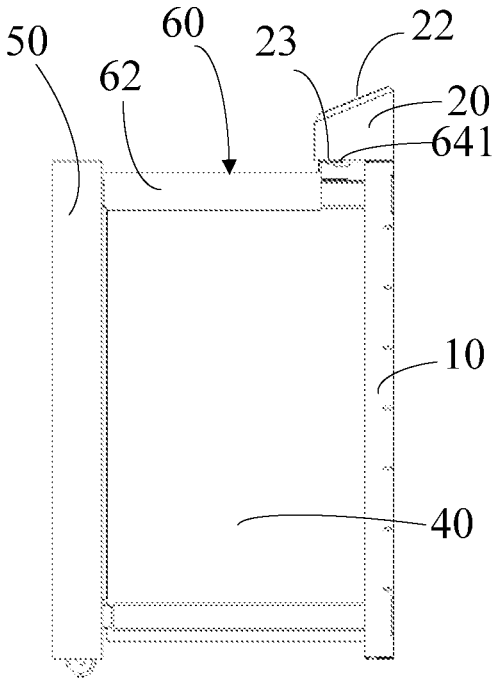
FIG. 13 is a schematic view according to FIG. 9 showing the active element covering the top of the bag and engaging with the lock assembly.

Next, as shown in FIG. 13, the mounting element 50 moves slightly toward the rear cover 10 so that the first retaining sheet 641 reaches a location under the lock assembly 20. Afterwards, the physical lock 23 passes through the locking hole 643 on the first retaining sheet 641 by operating a button on the control panel 22, thereby fixing the first retaining sheet 641 to the lock assembly 20. As a result, a movement between the mounting element 50 and the active element 60 can be limited, and the active element 60 covers the top of the bag 40. In one embodiment, when the active element 60 covers the top of the bag 40 and engages with the lock assembly 20, the two side frames 62, the rear cover 10, and the mounting element 50, surround the opening 410. Therefore, the items in the bag 40 are secured.

Many details are often found in the art such as the other features of secure containing device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A secure containing device comprising:
a bag;
a rear cover in a first side of the bag;
a mounting element in a second side of the bag opposite to the first side;
a lock assembly on the rear cover, and protruding toward the mounting element;
an active element overlapping with the mounting element;
wherein the mounting element is movable between a closed position and an unfolded position, wherein in the closed position, the mounting element is nearest to the rear cover and the bag is compressed, and in the unfolded position, the bag defines a containing space therein,
wherein when the mounting element is in the unfolded position, the active element is movable and rotatable relative to the mounting element, so that the active element covers a top of the bag and engages with the lock assembly.

2. The secure containing device as claimed in claim 1, wherein the mounting element is movable relative to the rear cover by a plurality of connecting-rod assemblies, and the plurality of connecting-rod assemblies comprises a plurality of first connecting rods and a plurality of second connecting rods each pivoted to a corresponding one of the plurality of first connecting rods;
wherein when the mounting element is moved to the closed position, a first angle between each of the plurality of first connecting rods and the corresponding one of the plurality of second connecting rods is less than 10 degrees, and when the mounting element is moved to the unfolded position, a second angle between each of the plurality of first connecting rods and the corresponding one of the plurality of second connecting rods is less than or equal to 180 degrees, the second angle is greater than the first angle.

3. The secure containing device as claimed in claim 2, wherein the bag comprises a plurality of sleeves, and each of the plurality of connecting-rod assemblies is movably disposed in a corresponding one of the plurality of sleeves.

4. The secure containing device as claimed in claim 1, wherein the active element comprises a first retaining sheet and a second retaining sheet perpendicular to the first retaining sheet, and each of the first retaining sheet and the second retaining sheet comprises a locking hole,
wherein when the mounting element is in the unfolded position, and the active element covers the top of the bag and engages with the lock assembly, the lock assembly extends through the locking hole of the first retaining sheet.

5. The secure containing device as claimed in claim 4, wherein when the mounting element is in the closed position, the lock assembly extends through the locking hole of the second retaining sheet.

6. The secure containing device as claimed in claim 1, wherein the bag comprises a body and an inner cover, the body comprise an opening on a top of the body, the inner cover is configured to seal the opening, wherein when the active element covers the top of the bag and engages with the lock assembly, the active element covers the inner cover to prevent the inner cover from opening.

7. The secure containing device as claimed in claim 6, wherein the active element comprises a top frame and two side frames extending from two opposite sides of the top frame, wherein when the active element covers the top of the bag and engages with the lock assembly, the two side frames, the rear cover, and the mounting element surround the opening.

8. The secure containing device as claimed in claim 6, wherein the bag is coated with waterproof coating.

9. The secure containing device as claimed in claim 1, wherein the mounting element comprises a guiding track, the active element comprises a cylindrical protrusion, and the cylindrical protrusion is movably disposed in the guiding track, so that the active element is slidable relative to the mounting element.

10. The secure containing device as claimed in claim 1, further comprising a wheel disposed on a bottom of the mounting element.

* * * * *